United States Patent [19]

Halm

[11] Patent Number: 5,052,071

[45] Date of Patent: Oct. 1, 1991

[54] TOOTHBRUSH WITH DISPLACEABLE HEAD

[75] Inventor: Hans Halm, Herne, Fed. Rep. of Germany

[73] Assignee: Lingner+Fischer GmbH, Fed. Rep. of Germany

[21] Appl. No.: 329,950

[22] Filed: Mar. 29, 1989

[30] Foreign Application Priority Data

Mar. 31, 1988 [GB] United Kingdom ..... 8807673

[51] Int. Cl.[5] ..... A46B 9/04

[52] U.S. Cl. ..... 15/167.1; 15/143 R; 15/172

[58] Field of Search ..... 15/143 R, 144 R, 167.1, 15/167.2, 172, 201; 16/110 R, ; 81/489

[56] References Cited

U.S. PATENT DOCUMENTS

| | | | |
|---|---|---|---|
| 2,360,745 | 10/1944 | Vogel | 15/167.1 |
| 3,972,528 | 8/1976 | McCracken et al. | 15/143 R |
| 4,520,526 | 6/1985 | Peters | 15/167.1 |
| 4,712.266 | 12/1987 | Yamaki et al. | 15/167.1 |
| 4,721,021 | 1/1988 | Kusznir | 81/489 |

FOREIGN PATENT DOCUMENTS

| | | | |
|---|---|---|---|
| 3612108 | 10/1987 | Fed. Rep. of Germany . | |
| 3640898 | 1/1988 | Fed. Rep. of Germany . | |
| 1005685 | 4/1952 | France | 15/167.1 |
| 485723 | 10/1953 | Italy | 15/143 R |
| 155730 | 9/1932 | Switzerland | 15/167.1 |
| 447279 | 5/1936 | United Kingdom | 15/143 R |

*Primary Examiner*—Philip R. Coe
*Assistant Examiner*—Mark Spisich
*Attorney, Agent, or Firm*—Rosenman & Colin

[57] ABSTRACT

A toothbrush has a handle of plastics material and, at one end thereof, a head, the handle including, as integral parts thereof, a grip portion, a resiliently flexible portion and a head-carrying portion, the resiliently flexible portion comprising at least one transverse V-shaped fold formed integrallly with the remainder of the handle and in a plane at from 30° to 150°, preferably substantially at right-angles, to that in which the handle lies, whereby the resiliently flexible portion permits the head-carrying portion, on the application of pressure to the head, to be moved at an angle to the grip portion and out of the plane in which it normally lies, and to revert to its original position on the release of pressure.

16 Claims, 2 Drawing Sheets

TOOTHBRUSH WITH DISPLACEABLE HEAD

BACKGROUND OF THE INVENTION

1. Field of the Invention

The present invention relates to a toothbrush, and in particular to a toothbrush having a flexible zone in the handle.

2. Description of Related Art

When brushing one's teeth, particularly with a conventional straight rigid toothbrush, it can be difficult to reach all parts of the mouth in order to brush the teeth satisfactorily. It is also difficult with such brushes to maintain an optimum angle between the teeth and the head of the toothbrush for effective brushing and cleaning, necessitating continual repositioning of the brush in the hand throughout the brushing process. Consequently, there is a tendency to apply excess brushing pressure to some teeth and insufficient pressure to other teeth. The resultant combination of excess brushing pressure and inadequate cleaning or bad cleaning technique can result in damage to both teeth and gums.

Although angled-head toothbrushes have been suggested, as an attempt to overcome some of these difficulties, they do not satisfactorily meet all the requirements.

Proposals have also been made for toothbrushes having moveable heads, but these involve multiple parts and are consequently difficult and somewhat expensive to manufacture and are thus not commercially attractive. They can also be somewhat awkward to use.

In a toothbrush having a flexible zone in the handle, it is necessary to balance the flexibility against sufficient rigidity to ensure adequate and proper brushing, whilst still retaining a compact shape and size. DE-C-3 640 898 describes a toothbrush in which the flexible zone is integral with the handle and head and of relatively narrow, circular cross section to impart equal flexibility in all directions and to make that zone more flexible than, the handle.

SUMMARY OF THE INVENTION

The present invention now provides a toothbrush having a handle of plastics material and, at one end thereof, a head, the handle including, as integral parts thereof, a grip portion, a resiliently flexible portion and a head-carrying portion, the resiliently flexible portion comprising at least one transverse V-shaped fold formed integrally with the remainder of the handle and in a plane at from 30° to 150°, preferably substantially at right-angles, to that in which the handle lies, whereby the said resiliently flexible portion permits the said head-carrying portion, on the application of pressure to the head, to be moved at an angle to the said grip portion and out of the plane in which it normally lies, and to revert to its original position on the release of said pressure.

BRIEF DESCRIPTION OF THE DRAWINGS

One form of toothbrush according to the present invention will now be described, by way of example only, with reference to the accompanying drawings, in which.

DETAILED DESCRIPTION OF THE PREFERRED EMBODIMENT

Figure 1:
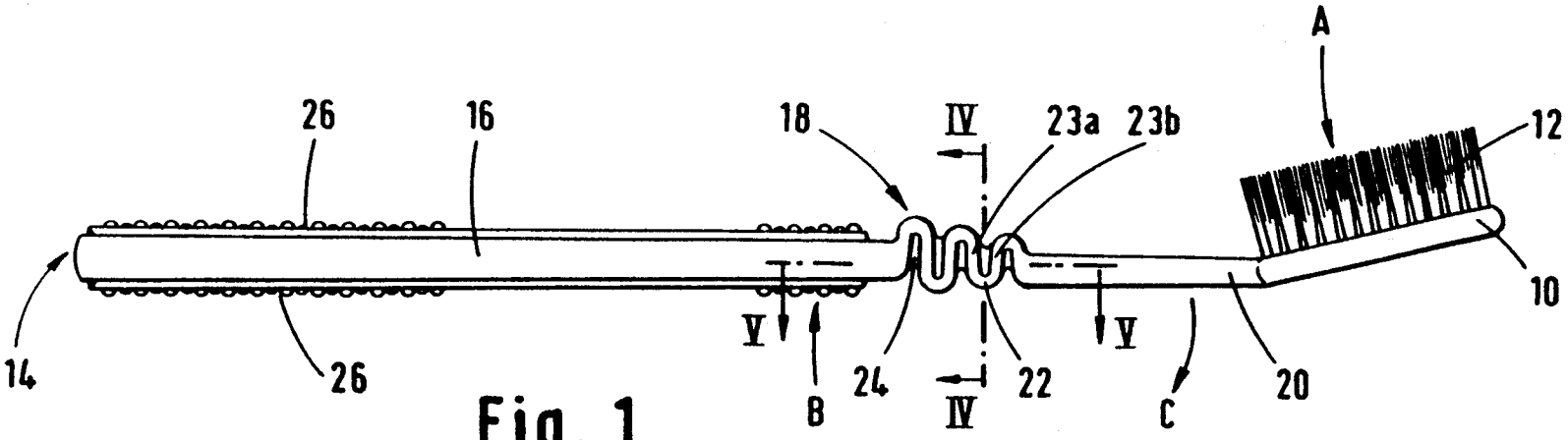
FIG. 1 shows a side view of the toothbrush.
Figure 4:
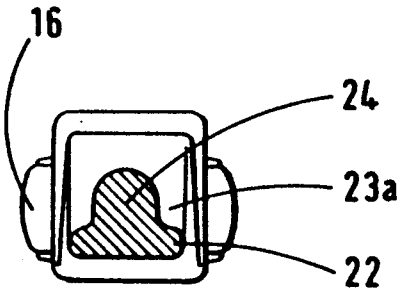
FIG. 4 shows a vertical cross-sectional view along the line IV—IV of FIG. 1.
Figure 5:
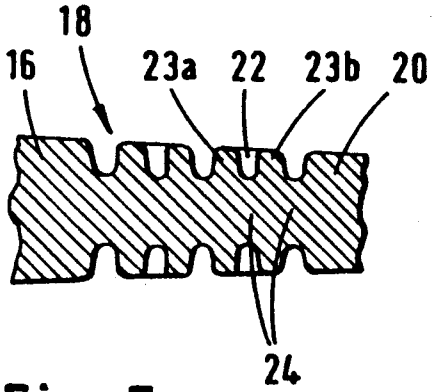
FIG. 5 shows a horizontal cross-sectional view along the line V—V of FIG. 1.

The toothbrush comprises a head 10, carrying bristles 12, and a handle 14, which includes a grip portion 16, a resiliently flexible portion 18, and a head-carrying portion 20. The head 10 and the three portions 16, 18, 20 of the handle 14 are integrally formed of a resiliently flexible plastics material. Suitable plastics materials include, for example, polyamides and polypropylenes. An example of a suitable polyamide is the material 'Ultramid B3' (Trade mark, marketed by BASF, Federal Republic of Germany), having a modulus of elasticity (DIN 53452) of 3000. An example of a suitable polypropylene is the material 'Novolene 1100 HX' (Trade mark, marketed by BASF, Federal Republic of Germany), which is a homopolymer and has a modulus of elasticity (DIN 53457) of 1400. Such a polypropylene homopolymer may optionally be used in admixture with a polypropylene block co-polymer, such as the material 'Novolene 2500 HX' (Trade mark, marketed by BASF, Federal Republic of Germany), for example in an 80:20 mixture by weight (1100 HX:2500 HX).

Figure 2:
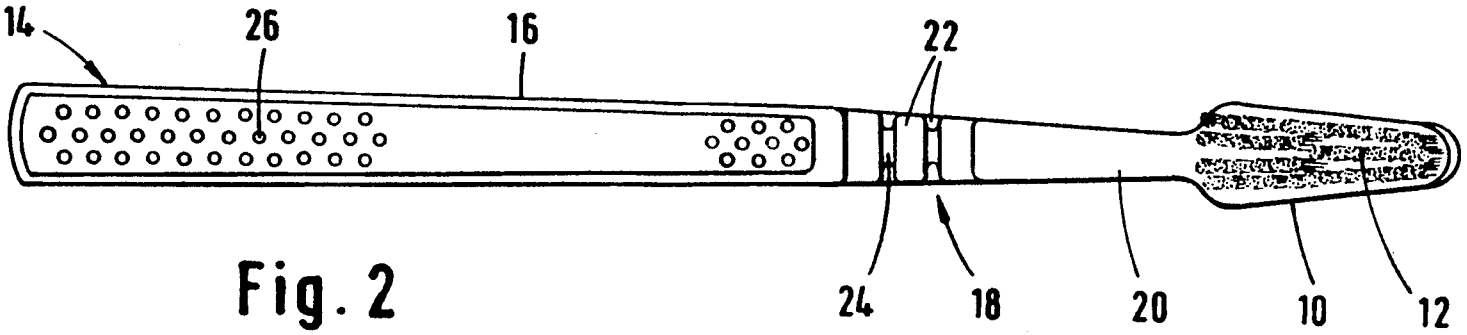
FIG. 2 shows a top plan view of the toothbrush.
Figure 3:
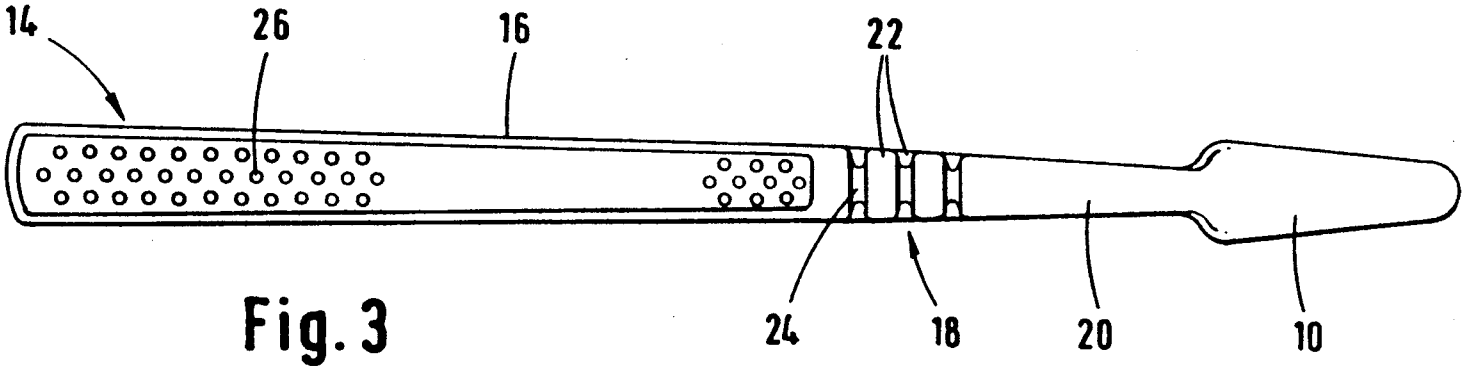
FIG. 3 shows an underneath plan view of the toothbrush.

The resiliently flexible portion 18 comprises five alternately inverted, transverse, V-shaped folds 22 (as may most clearly be seen in FIG. 1). These together form a plurality of transverse S-shaped folds. (It will be appreciated that two V-shaped folds together may also be described as an S-shaped fold.) The V-shaped folds 22 each lie in the vertical plane (as seen in FIG. 1), with the handle 14 and its longitudinal axis lying in the horizontal plane. Thus the two said planes are mutually at right-angles. Each V-shaped fold 22 lies transversely across the whole width of the handle 14 (see FIGS. 2 and 3).

One or more of the V-shaped folds could alternatively be in the form of a more open fold, so that the two arms 23*a,b* of the fold are at an angle to one another rather than substantially mutually parallel.

Across each V-shaped fold 22 is a longitudinal structural rib 24.

When the brush is in use, pressure applied against the head 10 by the teeth, as shown by arrow A (see FIG. 1), while the grip portion 16 is held securely in the hand with the application of finger pressure as shown by arrow B, will cause the head-carrying portion 20 to move a short distance at an angle to the grip portion 16, as shown by arrow C, out of the horizontal plane (as seen in FIG. 1) in which it normally lies. Release of the pressure at A and B will permit the head-carrying portion 20 to return to its normal position by virtue of the resilience of the flexible portion 18.

The degree of flexibility and rigidity of the flexible portion 18 of the handle may be varied by varying the number and/or the thickness of the V-shaped folds 22. In general, flexibility will increase with increasing number of folds and with decreasing thickness of the material of the folds. Preferably, the flexible portion 18 includes between two and eight, more preferably four, five or six, advantageously five V-shaped folds 22 which are preferably alternately inverted. In general, the thickness of the walls of the folds will be somewhat less than the thickness of the grip portion 16 of the handle.

The structural ribs 24 impart additional rigidity to the flexible portion 18. Such ribs may, if desired, be omitted or reduced in size in order to increase the degree of flexibility.

Thus, the desired balance of flexibility and rigidity may be obtained by varying the number and/or thickness of V-shaped or S-shaped folds and including, omitting or varying the size of the structural ribs. The fact that the degree of flexibility and rigidity can be altered in two separate ways means that, if it is desired to have a greater number of V-folds (say, five), for aesthetic reasons, the greater flexibility that this would impart may be counterbalanced by the rigidity provided by the structural ribs.

Thus, the structural arrangement of the flexible portion 18 according to the present invention enables the desired balance of flexibility, rigidity, resilience and aesthetic appeal to be achieved.

Each face of the grip portion 16 of the handle carries an embossed rubber or rubber-like grip mat 26 to improve hand grip of the handle 14, particularly when wet. The embossing may be in the form of ribs, raised dots, or the like, or alternatively the grip mat 26 could include, for example, recessed grooves instead of embossing. The grip mat 26 may be secured to the surface of the grip portion 16 of the handle 14 or may be inset into it. In either case, it may be secured by adhesion, which may be by self-adhesion or by a separate adhesive film. Another method of securing the grip mats 26 is to have perforations within the grip portion 16 through which the rubber or rubber-like material of the grip mats 26 extends such that the two grip mats 26 are secured together through the handle. This latter method can be particularly advantageous when the handle 14 is of a material (such as polyamide) to which the grip mats will not readily adhere.

It has been found advantageous to form the grip mats 26 of a material having a Shore hardness A of from 50 to 90, preferably from 65 to 75 (DIN 53505).

Alternatively, the grip mats 26 could be omitted and the grip portion 16 of the handle 14 could include integral embossing or recessing to improve hand grip in a conventional manner.

I claim:

1. A toothbrush comprising:

(a) an elongated handle constituted of synthetic plastic material and extending along a central longitudinal axis between a grip handle portion and a head-carrying handle portion, said grip handle portion having a central longitudinal plane in which the grip handle portion lies in a non-flexed position;

(b) a head supported by the head-carrying handle portion and having a plurality of bristles on, and projecting from, the head; and (c) resilient flexible means integral with the handle between the grip handle portion and the head-carrying handle portion for permitting angular joint displacement of the head-carrying handle portion and the head relative to the grip handle portion out of the non-flexed position and in a displacement plane normal to the central longitudinal plane, said resilient flexible means including at least one pair of arm interconnected at a fold that extends along a fold axis parallel to the central longitudinal plane and perpendicular to the displacement plane, said bristles on the head projecting substantially parallel to the displacement plane.

2. The toothbrush according to claim 1, and further comprising a structural rib extending along the longitudinal axis between said at least one pair of arms.

3. The toothbrush according to claim 2, wherein the head is constituted of synthetic plastic material and is integral with the head-carrying handle portion, and wherein said at least one pair of arms is also constituted of synthetic plastic material and is integral with the handle, and wherein said structural rib is constituted of synthetic plastic material and is integral with the handle.

4. The toothbrush according to claim 1, wherein said at least one pair of arms and said fold together have a generally V-shaped configuration as considered in said displacement plane.

5. The toothbrush according to claim 1, wherein said arms of said at least one pair are substantially mutually parallel, and wherein said arms of said at least one pair and said fold together have a generally U-shaped configuration as considered in said displacement plane.

6. The toothbrush according to claim 1, wherein said arms of said at least one pair extend in a plane that is at an angle in a range from about 30° to about 150° with the plane in which the grip handle portion lies.

7. The toothbrush according to claim 1, wherein the resilient flexible means includes a plurality of pairs of arms, each interconnected at respective folds that respectively extend along respective folding axes, all of said folding axes extending in mutual parallelism.

8. The toothbrush according to claim 7, wherein the folds are arranged in an alternately inverted pattern along the longitudinal axis.

9. The toothbrush according to claim 7, wherein there are between two and eight folds.

10. The toothbrush according to claim 9, wherein there are five folds.

11. The toothbrush according to claim 7, and further comprising a plurality of structural ribs, each extending along the longitudinal axis between each pair of arms.

12. The toothbrush according to claim 1, wherein the handle has a transverse width dimension that is perpendicular to the central longitudinal axis, and wherein the arms of said one pair extend across said width dimension.

13. The toothbrush according to claim 1, and further comprising grip enhancement means on the grip portion for enhancing a user's grip on the handle.

14. The toothbrush according to claim 13, wherein the grip enhancement means includes at least one mat on the grip portion, said mat having raised sections.

15. The toothbrush according to claim 13, wherein the grip enhancement means includes two mats on the grip portion at opposite sides of the central longitudinal plane.

16. The toothbrush according to claim 13, wherein the grip enhancement means includes at least one mat on the grip portion, said mat having recessed sections.

* * * * *